United States Patent [19]

Moore

[11] 4,181,229

[45] Jan. 1, 1980

[54] RESILIENT PARTITION FOR USE WITH PERFORATED SHELVING

[75] Inventor: David M. Moore, Pittsburgh, Pa.

[73] Assignee: Armstrong Store Fixtures Corporation, Pittsburgh, Pa.

[21] Appl. No.: 885,668

[22] Filed: Mar. 13, 1978

[51] Int. Cl.[2] ..... A47F 5/00

[52] U.S. Cl. ..... 211/184; 108/61

[58] Field of Search ..... 211/184, 43; 248/220.4, 248/221.1, 221.2, 221.4; 220/22, 22.1, 22.2, 22.3; 108/61

[56] References Cited

U.S. PATENT DOCUMENTS

| | | | |
|---|---|---|---|
| 2,991,968 | 7/1961 | Lydard | 248/221.1 |
| 3,497,081 | 2/1970 | Field | 211/184 |
| 3,501,019 | 3/1970 | Armstrong et al. | 211/184 |
| 3,692,191 | 9/1972 | Moore | 211/184 |
| 3,954,184 | 5/1976 | Mendenhall | 211/184 |

*Primary Examiner*—Roy D. Frazier
*Assistant Examiner*—Robert W. Gibson, Jr.
*Attorney, Agent, or Firm*—Parmelee, Miller, Welsh & Kratz

[57] ABSTRACT

A partition for separating merchandise or allocating space on perforated shelving includes an elongated planar body member and a pair of spaced feet extending laterally from one elongated edge of the body member. The integrally molded partition is made of a resilient yet stiff material such that the planar body member may be twisted about a longitudinal axis to insert first one and then the other of the feet into spaced perforations in the shelving. When the twist is released the partition is held firmly on the shelving in an upright position.

9 Claims, 6 Drawing Figures

RESILIENT PARTITION FOR USE WITH PERFORATED SHELVING

BACKGROUND OF THE INVENTION

1. Field of the Invention

This invention relates to partitions which are used to separate merchandise or allocate space on display shelves and more particularly to such devices for use on perforated shelving.

2. Prior Art

A popular type of shelving now in use for displaying merchandise is perforated with a continuous pattern of circular, diamond or other shaped holes into which devices may be inserted to secure partitions or other devices used for dividing or segregating merchandise on the shelves. Glass partitions and now some plastic partitions are secured in an upright position on the perforated shelving by splicer units which are U-shaped brackets with a vertical slot which receives the end of the partition. The splicer units are connected to the perforated shelving by undercut projections inserted into the perforations and are secured in place by the wedging effect of the partitions tending to spread the splicer units at opposite ends of the partition apart. Some wire partitions are secured to perforated shelving by adapter plates welded to the bottom of the partition which give it needed lateral stability. Hooks depending from the plates in opposite directions parallel to the plane of the partition are locked into place in the shelving by spreading the hooks apart through pulling on the ends of the partition, inserting the hooks in spaced perforations and releasing the ends of the partition. Similarly, in the plastic partition disclosed in U.S. Pat. No. 3,501,019 an integral S-shaped resilient mounting for one hook permits the oppositely directed hooks to be spread apart to insert them in the perforations and then pulls them together to lock the partition in an upright position. In another type of wire merchandise separator, a resilient U-shaped portion of the wire rests on the perforated surface with adapter plates attached to the legs of the U. The two legs of the U are squeezed together to insert hooks, extending from the adapter plates in opposite directions transverse to the legs, into spaced perforations on the shelf and then released to lock the separator in place.

The merchandise separator of my concurrently filed and commonly owned application has an integrally molded flange on the bottom elongated edge of the partition which terminates, at least at one end, in a tongue extending parallel to the elongated edge on each side of the portion. These tongues are inserted into separate perforations in the shelving where they bear against the underside of the shelving to support the partition in an upright position.

The primary object of the present invention is to provide a merchandise separator which is simple in design and eliminates the need for separate adapters or splicers.

Another object is to provide such a device which is easily installed yet locks itself firmly in place. Yet another object is to provide such a device which is simple in design and can be easily and economically constructed.

SUMMARY OF THE INVENTION

According to the invention, a shelf partition for use with perforated shelving comprises an elongated planar body member and a pair of spaced feet extending laterally in opposite directions from one elongated edge thereof. The planar body member is resilient yet stiff such that it may be twisted about a longitudinal axis to insert one and then the other of said feet into perforations in said perforated shelving to secure the body member upright on the shelf when the twist is released. The laterally extending feet may be spaced from the body member by extension members extending in the plane of the elongated member from the one elongated edge thereof. Additionally, a flange may be provided along the elongated edge of the planar member to provide stability and a wider base for connection of the extension members and preferably the flange extends laterally from each side of the elongated planar member.

Preferably, the extension members space the feet from the elongated edge a distance slightly less than the thickness of the perforated shelving. It is also desirable that the feet extend laterally from the extension members at an obtuse angle, which preferably may be 90 to 95 degrees.

Description of the Preferred Embodiment

Figure 1:
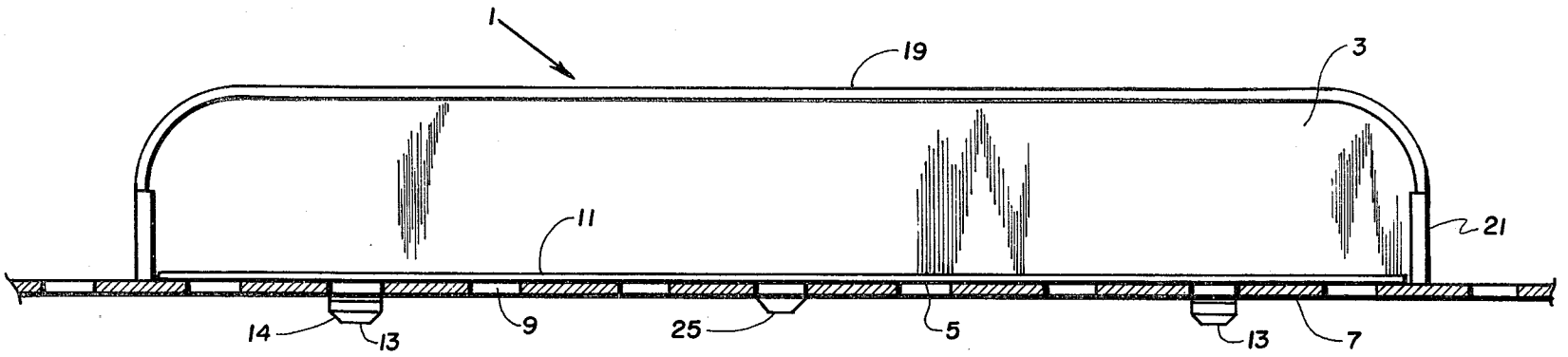
FIG. 1 is a side elevation view partially in section of a partition according to the invention shown in place on a perforated shelf.
Figure 2:
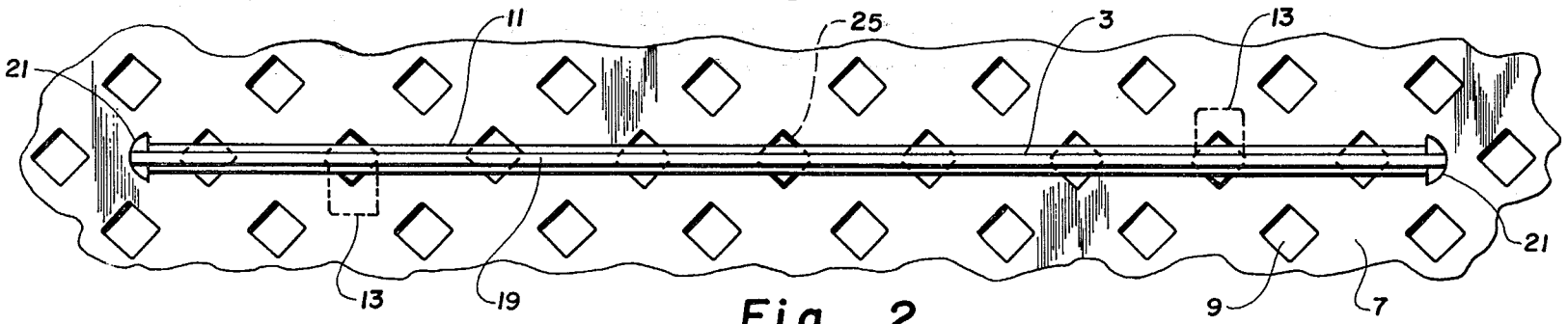
FIG. 2 is a plan view of the partition of FIG. 1.
Figure 3:
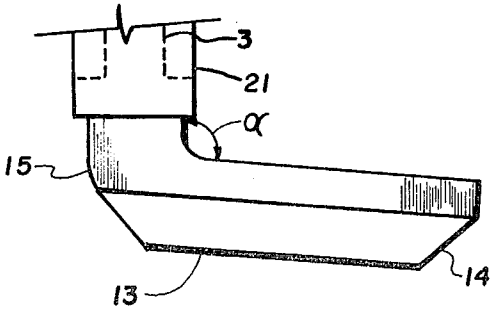
FIG. 3 is an enlarged end elevation view of one of the feet of a partition constructed in accordance with the invention.

FIGS. 1 and 2 illustrate a partition 1 according to the invention which comprises an elongated planar body member 3 which rests on one elongated edge 5 thereof on a section of shelving 7 perforated by a plurality of diamond shaped holes 9. It is understood that the shape of the holes 9 is not critical and that they may be round, square or any other desired shape. A T-shaped flange 11 extending along the elongated edge 5 gives the partition 1 added lateral stability as it rests on its edge and provides a base from which a pair of spaced, integral feet 13 extend laterally in opposite directions from the plane of the elongated planar body member 3. The feet 13 are spaced from the elongated edge 5 as defined by the flange 11 by extension members 15 as best seen in FIG. 3. With the feet 13 inserted in spaced perforations 9 in the shelving 7 as shown in FIGS. 1 and 2, the partition 1 is held in an upright position on the shelf and suitably divides the shelf space for the segregation of merchandise.

In order to assure a snug fit of the feet 13 against the underside of the shelving 9, the extension members 15 space the laterally extending feet from the flange 11 by a distance slightly less than the thickness of the perforated shelving 7. In addition, the feet 13 form an obtuse angle $\alpha$ of between 90 and 95 degrees, and preferably about 92 degrees, with the extension member 15. For use with shelving having diamond shaped perforations as shown in the drawings, the bottom edges of the feet 13 are bevelled all around as at 14 to facilitate their insertion and removal.

Figure 5:
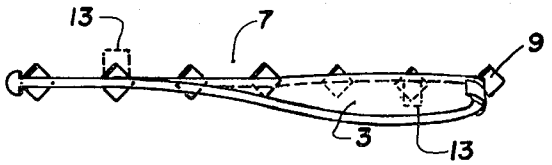
FIG. 5 is a plan view of the partition twisted as shown in FIG. 4.
Figure 4:
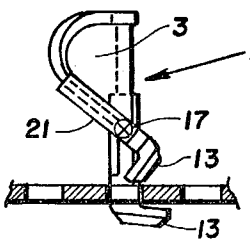
FIG. 4 is an end elevation view partially in section of a partition according to the invention which has been twisted about a longitudinal axis for insertion of the feet into perforations in the perforated shelving.

The partition 1 is integrally molded from a flexible yet stiff material such as polycarbate, nylon, burate or of any material having these desired characteristics. In order to install the partition on the perforated shelving, one foot 13 is inserted into a hole 9 in the shelving and then the elongated planar body member 3 is twisted about a longitudinal axis 17 so that the other foot 13 may be inserted into another perforation in the shelving 7 as shown in FIGS. 4 and 5. Due to the resilience of the partition, the elongated body member 3 will untwist to assume the position shown in FIGS. 1 and 2 when released and will firmly remain in an upright position.

Figure 6:
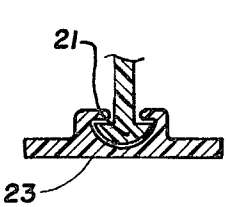
FIG. 6 is a plan view of one end of a partition according to the invention illustrating the mounting of a ticket holder thereon.

The integrally molded partition may be provided with an additional flange 19 along the upper edge thereof for appearance and stiffness and may also be provided with a vertical flange 21 on one or both ends for engaging a vertical undercut groove in a ticket holder 23 as shown in FIG. 6. Long partitions may be provided with one or more integrally molded depending stabilizer pins 25 which are inserted into separate perforations in the shelving to provide lateral stability by precluding deflection of the center portion of the planar body member 3.

The described partition is an attractive merchandise separator which is easily, quickly and firmly installed in place without any tools or separate fasteners and any number of them can be arranged in any desired pattern to divide up the area on a shelf. At the same time the single piece unit can be easily and inexpensively manufactured.

I claim:

1. A shelf partition for use with perforated shelving comprising an elongated planar body member and a pair of spaced feet extending laterally out of the plane of said planar body member in opposite directions from one elongated edge thereof, said planar body member being resilient yet stiff such that it may be twisted about a longitudinal axis to insert one and then the other of said feet into spaced perforations in said perforated shelving to secure said body member upright on said shelving when the twist is released.

2. The partition of claim 1 including extension members to which said feet are attached extending from said one elongated edge of said planar body member in the direction of the plane thereof to space said laterally extending feet from said one elongated edge.

3. The partition of claim 2 including a flange extending along said one elongated edge of said elongated planar member to increase the lateral stability thereof and to provide a wider base for the connection of said extension members to said planar body.

4. The partition of claim 3 wherein said flange extends laterally from each side of the elongated edge of said planar member.

5. The partition of claim 2 wherein said extension members space said feet from said elongated edge a distance slightly less than the thickness of said perforated shelving.

6. The partition of claim 5 wherein said feet extend laterally from said extension members in a direction which forms an obtuse angle with the direction in which the extension members extend from the elongated edge of the planar member.

7. The partition of claim 6 wherein said obtuse angle is between 90 and 95 degrees.

8. The partition of claim 1 including a stabilizer extending in the direction of the plane of said elongated planar body member from said one elongated edge intermediate said spaced feet, for insertion in a perforation in the shelving to provide lateral stability for the center of said resilient, elongated, planar body member.

9. The partition of claim 1 wherein each of said laterally extending feet has a face transverse to and directed away from the planar body member and wherein the edges of said face are bevelled to facilitate insertion into and removal of said feet from diamond shaped perforations in shelving.

* * * * *